United States Patent [19]

Gotschewski

[11] Patent Number: 4,896,875

[45] Date of Patent: Jan. 30, 1990

[54] COPY SHEET PULL GUIDE MECHANISM

[75] Inventor: Robert P. Gotschewski, Schaumburg, Ill.

[73] Assignee: AM International, Inc., Chicago, Ill.

[21] Appl. No.: 287,771

[22] Filed: Dec. 21, 1988

[51] Int. Cl.[4] ..... B65H 9/00

[52] U.S. Cl. ..... 271/236; 271/252

[58] Field of Search ..... 271/236, 237, 248, 249, 271/250, 252, 253, 254, 255

[56] References Cited

U.S. PATENT DOCUMENTS

| | | | |
|---|---|---|---|
| 1,986,253 | 1/1935 | Cross | 271/252 |
| 2,712,936 | 7/1955 | Backhouse | 271/252 |
| 2,836,417 | 5/1958 | Gericke | 271/252 |

*Primary Examiner*—Richard A. Schacher

*Attorney, Agent, or Firm*—Wood, Dalton, Phillips, Mason & Rowe

[57] ABSTRACT

A pull guide mechanism for moving a copy sheet transversely of a conveyor board into proper registration in a printing, duplicating or like machine. A drive wheel is rotatably mounted in the conveyor board and a pressure wheel is disposed above the conveyor board for sandwiching a copy sheet therebetween and pulling the sheet into proper registration in response to driven rotation of the drive wheel. A carriage is mounted on the machine for reciprocal movement toward and away from the conveyor board and the drive wheel. A spring biased piston is mounted on the carriage for limited yielding movement relative to the carriage. The pressure wheel is rotatably mounted on the piston for movement with the carriage toward and away from the drive wheel and for gripping a copy sheet between the wheels against the spring bias. A first adjusting device adjusts the position of the piston relative to the carriage and thereby adjusts the dwell time that the wheels grip the copy sheet. A second adjusting device adjusts the biasing pressure of the spring. A third adjusting device is operatively associated with the first adjusting device for increasing the effective range of adjustment of the first adjusting device to set the mechanism for different weights of copy sheets.

20 Claims, 1 Drawing Sheet

FIG. 1
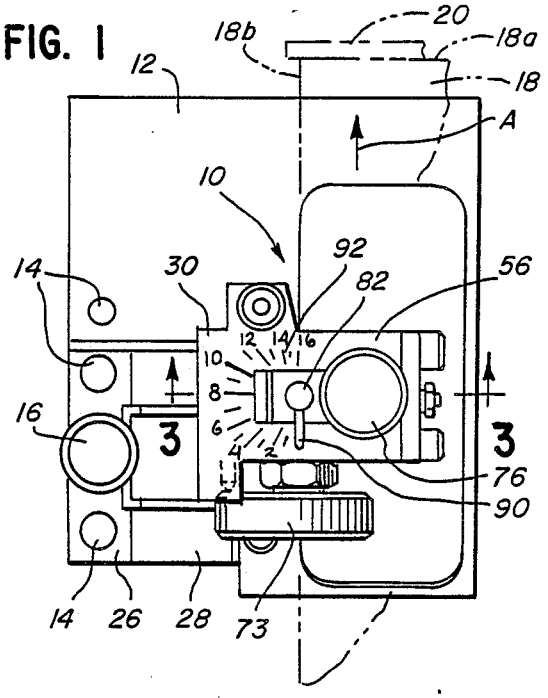
FIG. 3
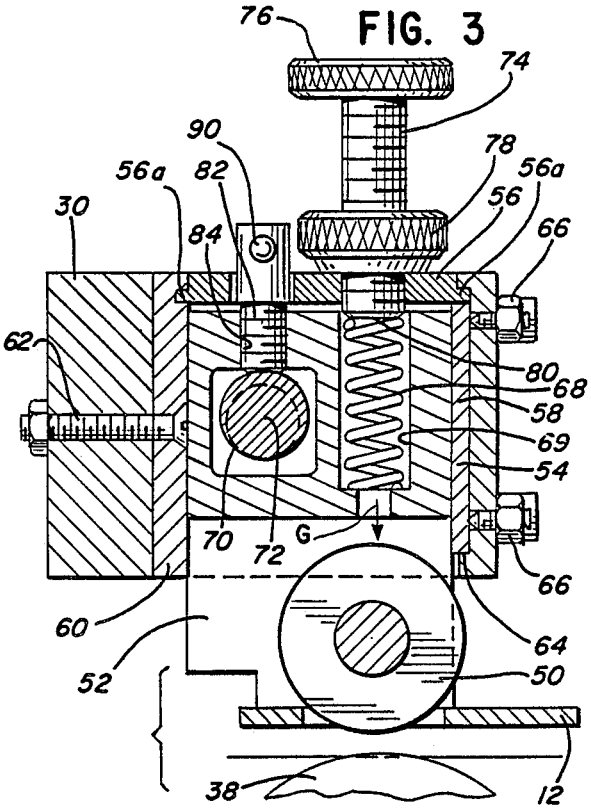
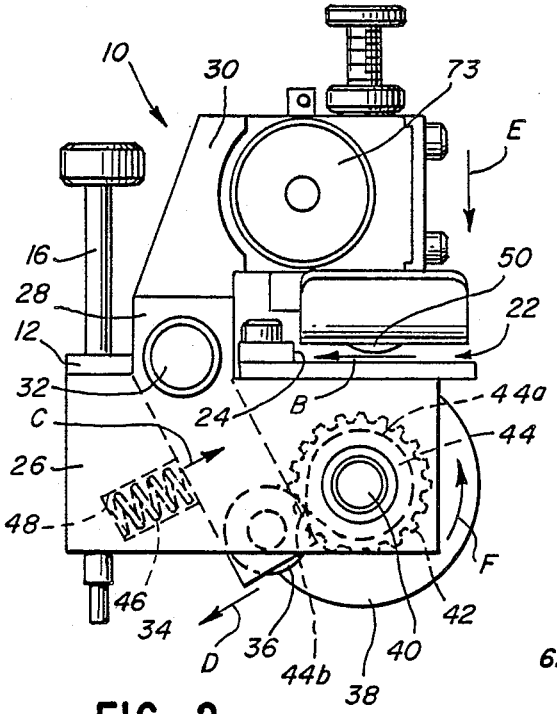
FIG. 2
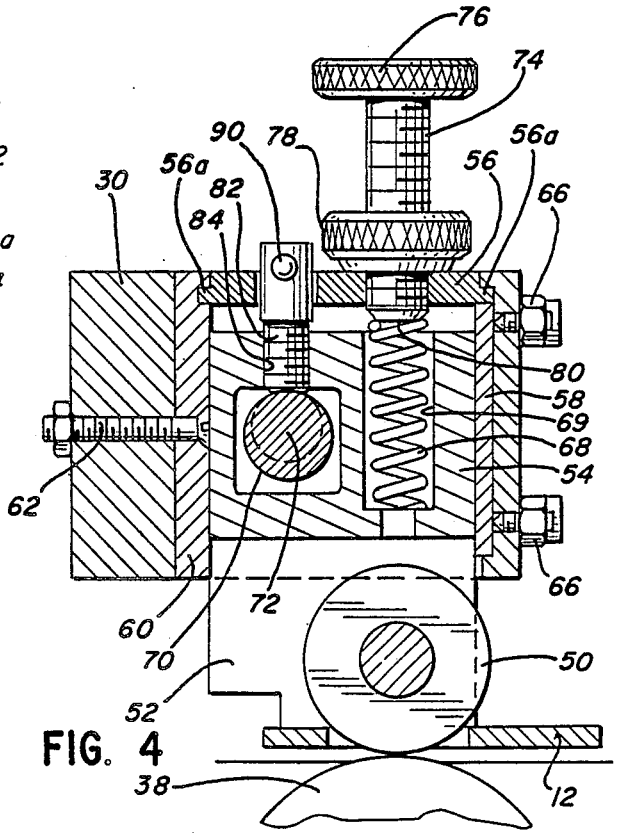
FIG. 4

COPY SHEET PULL GUIDE MECHANISM

FIELD OF THE INVENTION

This invention generally relates to printing, duplicating or like machines and, particularly, to a pull guide mechanism for moving copy sheets into proper registration in the machine.

BACKGROUND OF THE INVENTION

In printing, duplicating and like machines, copy sheets are fed seriatum over a conveyor board to a printing couple wherein images are duplicated on one or both sides of the sheet. In some machines, such as offset lithographic duplicating machines, the printing couple includes a number of rollers or cylinders, such as a master cylinder, a blanket cylinder and an impression cylinder. The cylinders are aligned in precise parallel relationship for high resolution of the images on the copy sheets. The copy sheets, themselves, must be fed into the printing couple in precise registration. Otherwise, the images will not be "square" with the copy sheets.

Each sheet is registered prior to being fed into the printing couple such that its leading edge is parallel to the axes of the printing couple cylinders. Conventionally, this is accomplished by some form of stop means for engaging the sheets as they move over the conveyor board, immediately prior to entering the printing couple, with the stop means being parallel to the cylinder axes.

In addition, each copy sheet must be registered laterally of the direction of movement, i.e. in a side-to-side direction, so that the copy sheets are centered as they are fed through the printing couple. This often is accomplished by a mechanism that conventionally is called a pull guide mechanism. Such devices literally grasp each copy sheet and pull the copy sheet laterally against a side stop which is in proper registration or alignment with the printing couple.

Such pull guide mechanisms often are quite complicated. They must be adjustable to accommodate different sizes and weights of copy paper as well as to adjust the pull guide mechanism for coordination with the other registration means and cylinders of the machine which, themselves, most often are adjustable.

This invention is directed to such pull guide mechanisms and, generally, to solving the continuing problem of providing a simplified and easily and accurately adjustable device.

SUMMARY OF THE INVENTION

An object, therefore, of the invention is to provide a new and improved pull guide mechanism for moving a copy sheet over a conveyor board into proper registration in a printing, duplicating or like machine.

Generally, the pull guide mechanism includes drive wheel means in the conveyor board and pressure wheel means above the conveyor board for sandwiching a copy sheet therebetween and pulling the copy sheet into proper registration in response to driven rotation of the drive wheel means. Carriage means are mounted on the machine for reciprocal movement toward and away from the conveyor board. Spring biased piston means are mounted on the carriage means for limited yielding movement relative to the carriage means. The pressure wheel means is rotatably mounted on the piston means for movement with the carriage means toward and away from the drive wheel means, and for gripping a copy sheet between the wheel means against the spring bias of the piston means.

First adjusting means are provided for adjusting the position of the piston means relative to the carriage means and thereby adjusting the dwell time that the wheel means grip the copy sheet. Second adjusting means are provided for adjusting the biasing pressure of the spring. Third adjusting means are provided operatively associated with the first adjusting means for effectively increasing the range of adjustment thereof to accommodate different weights of copy paper.

More particularly, in the preferred embodiment, the first adjusting means include adjustable abutment means on the carriage means against which the spring biases the piston means. As disclosed, the adjustable abutment means is in the form of an eccentric rotatably mounted on the carriage means. The third adjusting means for effectively increasing the range of adjustment of the first adjusting means, includes a rotatable screw member against which the eccentric abuts. Therefore, with the eccentric having a given range of adjustment defined by an eccentric peripheral surface thereof, the abutting screw member which engages the eccentric, also being adjustable, can increase the entire range of adjustment of the dwell time that the wheel means grip the copy sheet.

In the preferred embodiment, the second adjusting means include a screw member on the carriage means for compressing or expanding the spring means to adjust the pressure of the pressure wheel means against the copy sheet.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a top plan view of the pull guide mechanism of the invention;

FIG. 2 is a side elevational view of the mechanism, as viewed looking toward the bottom of FIG. 1;

FIG. 3 is a vertical section, on an enlarged scale, taken generally along line 3—3 of FIG. 1; and FIG. 4 is a section similar to that of FIG. 3, illustrating a different position of adjustment of the eccentric means.

DETAILED DESCRIPTION OF THE PREFERRED EMBODIMENT

Referring to the drawings in greater detail, and first to FIGS. 1 and 2, the invention is directed to a pull guide mechanism, generally designated 10, which is mounted to one side of a conveyor board of a printing, duplicating or like machine. In fact, the mechanism itself has a generally flat plate 12 which fits in the conveyor board and is mounted on the machine by any appropriate fastening means, such as screws or bolts 14, and including a pilot pin 16.

As viewed in the top plan view of FIG. 1, a copy sheet 18, shown in phantom, is fed over the conveyor board, through the pull guide mechanism, in the direction of arrow "A". Conventionally, the leading edge of the copy sheet is registered by some form of stop means prior to being fed through the printing couple of the machine so that the leading edge is parallel to the printing couple cylinders. For illustration purposes only, a front or leading edge registration means 20 is shown in FIG. 1 for engaging and registering the leading edge 18*a* of the copy sheet.

As viewed in FIG. 2, the copy sheet would be fed through pull guide mechanism 10 in a gap, generally designated 22, as will be understood hereinafter. In other words, as the figures are arranged, the copy sheet would be fed into the drawings as viewed in FIG. 2 (i.e. corresponding to the direction of arrow "A" in FIG. 1). The pull guide mechanism pulls the copy sheet laterally of the conveyor board in the direction of arrow "B" (FIG. 2) against a registration stop surface 24. Therefore, the leading edge 18*a* (FIG. 1) is properly registered, and the side edge 18*b* also is properly registered for feeding the sheet through the printing couple of the associated machine (not shown).

Pull guide mechanism 10 includes a subframe or mounting block 26 (FIG. 2) below plate 12. The mounting block includes an upwardly projecting ear 28. A carriage 30 is pivotally mounted, at 32, to ear 28 of mounting block 26. The carriage has a downwardly projecting lever arm 34 (FIG. 2) with a cam follower roller 36 freely rotatably mounted near the distal end of lever arm 34. A drive wheel 38 is mounted on a shaft 40 rotatably journaled in mounting block 26. The drive wheel is part of a unitary assembly which includes a gear 42 and a cam 44 all fixed together for rotation with shaft 40 relative to mounting block 26. Gear 42 is appropriately coupled in a gear train to the driving system of the copy machine whereby cyclical operation of the pull guide mechanism can be coordinated with other functional mechanisms of the copy machine, particularly the in-feed and copy feed mechanisms for the copy sheets. Cam 44 has a circular profile 44*a* and a single cam projection 44*b*. A coil spring 46 is positioned within an interior cavity 48 of mounting block 26 for applying spring pressure against lever arm 34 in the direction of arrow "C". Therefore, cam follower roller 36 is biased into constant engagement with cam 44 by spring 46 being biased against lever arm 34 of carriage 30. Of course, the spring also biases the entire carriage to an upper inoperative condition as shown in FIG. 2.

During a single revolution of gear 42, cam follower roller 36 will ride along the circular cam profile 44*a* of cam 44 until cam projection 36 engages the cam follower roller. When this happens, the entire carriage 36 will be pivoted at 32 such that cam follower roller 36 moves against spring 46 in the direction of arrow "D" and the upper carriage pivots downwardly in the direction of arrow "E".

As stated above, drive wheel 38 is rotated conjointly with gear 42 during operation of the machine. Drive wheel 38 is rotated in the direction of arrow "F". In order to grip a copy sheet, a pressure wheel 50 (FIG. 2) is freely rotatably mounted on carriage 30. Therefore, it can be understood that when carriage 30 is pivoted downwardly in the direction of arrow "E", pressure wheel 50 moves downwardly therewith and engages drive wheel 38 which is rotating in the direction of arrow "F". These wheels sandwich a copy sheet therebetween and grip the copy sheet to move the sheet in the direction of arrow "B" laterally of the conveyor board into proper registration against stop 24. As cam projection 44*b* passes cam follower roller 36, spring 46 biases the carriage back upwardly opposite the direction of arrow "E", carrying pressure wheel 50 therewith and releasing the copy sheet. The copy sheet then is left in proper registration against stop 24 and is free to be fed into the printing couple of the machine.

Referring to FIGS. 3 and 4, it can be seen that pressure wheel 50 is freely rotatably mounted between a pair of ears 52 (only one shown) of a piston 54 reciprocally mounted within carriage 30 for movement toward and away from the conveyor board and drive wheel 38. In other words, the piston and the pressure wheel move in conjunction with the carriage. The piston is mounted within a cavity or cylinder of the carriage, defined by a top plate 56 and side plates 58 and 60. Side plate 60 is secured to carriage 30 by means of a bolt 62. Side plate 58 is held in vertical position by a shoulder 64 on the carriage and is positioned against piston 54 by a pair of set screws 66. Therefore, the set screws can be used to adjust plate 58 to insure free movement of piston 54. Upper plate 56 is held in position by peripheral flanges 56*a* in complementary recesses in the side plates. Lastly, a coil spring 68 is disposed within a bore 69 in piston 54 to bias the piston and pressure wheel 50 downwardly in the direction of arrow "G" relative to carriage 30. This will be more clear with the further description hereinafter.

First adjusting means are provided for adjusting the position of piston 54 relative to carriage 30 and thereby adjusting the dwell time that wheels 50 and 38 grip the copy sheet. More particularly, an eccentric 70 is rotatably mounted on the carriage for rotation about an axis 72. The eccentric is fixed to and is rotated by means of a thumb wheel 73 (FIGS. 1 and 2) by an operator exteriorly of the pull guide mechanism. Therefore, it can be understood that if piston 54 abuts the top of eccentric 70, as viewed in FIG. 3, the position of the piston relative to the carriage is fixed. However, upon rotation of the eccentric, such as to the position shown in FIG. 4, the position of the piston relative to the carriage is changed. In the illustrations, the eccentric has been rotated in FIG. 4 180° from the position shown in FIG. 3. Consequently, the piston has been lowered, as shown. By lowering the piston, the dwell time during which pressure wheel 50 grips a copy sheet with drive wheel 38 is increased, as the piston yields against spring 68 during the dwell or gripping period which occurs each time cam projection 44*b* engages cam follower roller 36.

Second adjusting means are provided for adjusting the biasing pressure of spring 68. More particularly, a screw member 74 is threaded into upper plate 56 which, in essence, is fixed to carriage 30. A knurled thumb wheel 76 defines a head for screw member 74 for easy rotation of the screw member by an operator of the machine. A running nut 78 also is threaded onto screw member 74 for locking the screw member in any given position of adjustment, by tightening the running nut against the top of plate 56. The distal end of the screw member abuts against the top of coil spring 68, as at 80, whereas the lower end of the coil spring biases downwardly against the piston. Consequently, it can be seen that by rotating screw member 74, the spring can be compressed or expanded to increase or decrease, respectively, the yielding biasing pressure on pressure wheel 50. Of course, this increases or decreases the gripping forces on a copy sheet, because drive wheel 38 is fixed.

Third adjusting means are provided on piston 54, operatively associated with the first adjusting means defined by eccentric 70, for increasing the effective range of adjustment of the eccentric. This is provided to accommodate different weights of copy paper. More particularly, a threaded member 82 is threaded into a bore 84 in piston 54 such that the lower distal end 82 of the threaded member defines an abutment means for engaging eccentric 70. Since eccentric 70 has its own range of adjustment as determined by its circular profile and its degree of eccentricity, it can be understood that by changing the point at which the eccentric is able to abut the piston, the fixed range of adjustment of the eccentric can be increased.

In other words, looking at FIGS. 3 and 4, it can be understood that with threaded member 82 in the position shown, eccentric 70 has a range between the position shown in FIG. 3 (i.e. the upper limit position of piston 54) and the position shown in FIG. 4 (i.e. the lower limit position of piston 54) which are defined by 180° rotation of the eccentric. Without threaded member 82, this would be the total range of adjustment for the eccentric. However, threaded member 82 actually defines the abutment means between the eccentric and the piston. If the threaded member is rotated to move the piston upwardly from the position shown in FIG. 3, pressure wheel 50 would move upwardly therewith, thereby decreasing the dwell or gripping time of the pull guide mechanism. Yet, eccentric 70 still has its full range of adjustment.

A pointer 90 (FIG. 1) projects outwardly from threaded member 82 and points to a dial 92 on the top of plate 56. This dial can be used as a calibration for different weights of copy sheets. Effectively, by rotating threaded member 82, piston 54 and pressure wheel 50 can be dialed to a fixed position for any given weight paper which is most effective for that weight. This can be recorded in accordance with dial 92 for repetitive use. Once dialed, and as stated above, a full range of adjustment or eccentricity is afforded by eccentric 70 for any weight paper.

From the foregoing, it can be seen that a new and improved pull guide mechanism has been provided and which is of very simple construction but affords a wide range of adjustments. All of the adjustments are made by means of rotatable members. One adjustment changes the dwell or gripping time for a copy sheet. Another easy adjustment changes the spring biasing pressure or forces on the copy sheet. Still another adjustment expands the range of the dwell time adjusting means to condition the mechanism for different weights of paper.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A pull guide mechanism for moving a copy sheet over a conveyor board into proper registration in a printing, duplicating or like machine, comprising:

drive wheel means in the conveyor board and pressure wheel means above the conveyor board for sandwiching a copy sheet therebetween and pulling the sheet into said proper registration in response to driven rotation of the drive wheel means;

carriage means mounted on the machine for reciprocal movement toward and away from the conveyor board and the drive wheel;

spring biased piston means mounted on the carriage means for limited yielding movement relative thereto, the pressure wheel means being rotatably mounted on the piston means for movement with the carriage means toward and away from the drive wheel means and for gripping a copy sheet between the wheel means against the spring bias;

first adjusting means for adjusting the position of the piston means relative to the carriage means and thereby adjusting the dwell time that the wheel means grip the copy sheet; and second adjusting means for adjusting the biasing pressure of the spring.

2. The pull guide mechanism of claim 1 wherein said first adjusting means include adjustable abutment means on the carriage means against which the spring biases the piston means.

3. The pull guide mechanism of claim 2 wherein said adjustable abutment means comprise eccentric means rotatably mounted on the carriage means.

4. The pull guide mechanism of claim 2, including third adjusting means on the piston means operatively associated with the adjustable abutment means on the carriage means for increasing the effective range of the adjustable abutment means.

5. The pull guide mechanism of claim 4 wherein said third adjusting means include adjustable abutment means on the piston engageable by the adjustable abutment means on the carriage means.

6. The pull guide mechanism of claim 5 wherein said third adjusting means comprises a screw member.

7. The pull guide mechanism of claim 1 wherein said second adjusting means comprises a screw member on the carriage means engageable with the spring.

8. The pull guide mechanism of claim 7 wherein said spring comprises a coil spring sandwiched between the piston means and the screw member.

9. A pull guide mechanism for moving a copy sheet over a conveyor board into proper registration in a printing, duplicating or like machine, comprising:

drive wheel means in the conveyor board and pressure wheel means above the conveyor board for sandwiching a copy sheet therebetween and pulling the sheet into said proper registration in response to driven rotation of the drive wheel means;

carriage means mounted on the machine for reciprocal movement toward and away from the conveyor board and the drive wheel;

spring biased piston means mounted on the carriage means for limited yielding movement relative thereto, the pressure wheel means being rotatably mounted on the piston means for movement with the carriage means toward and away from the drive wheel means and for gripping a copy sheet between the wheel means against the spring bias;

first adjusting means for adjusting the position of the piston means relative to the carriage means and thereby adjusting the dwell time that the wheel means grip the copy sheet;

second adjusting means for adjusting the biasing pressure of the spring; and third adjusting means on the piston means operatively associated with the first adjusting means for increasing the effective range of the first adjusting means to set the pull guide mechanism for different weights of copy sheets.

10. The pull guide mechanism of claim 9 wherein said first adjusting means include adjustable abutment means on the carriage means against which the spring biases the piston means.

11. The pull guide mechanism of claim 10 wherein said adjustable abutment means comprise eccentric means rotatably mounted on the carriage means.

12. The pull guide mechanism of claim 10 wherein said third adjusting means include adjustable abutment means on the piston engageable by the adjustable abutment means on the carriage means.

13. The pull guide mechanism of claim 9 wherein said first adjusting means comprises eccentric means rotatably mounted on the carriage means, and said third adjusting means comprises a screw member for engaging the eccentric means.

14. The pull guide mechanism of claim 9 wherein said second adjusting means comprises a screw member on the carriage means engageable with the spring.

15. The pull guide mechanism of claim 14 wherein said spring comprises a coil spring sandwiched between the piston means and the screw member.

16. A pull guide mechanism for moving a copy sheet over a conveyor board into proper registration in a printing, duplicating or like machine, comprising:

drive wheel means in the conveyor board and pressure wheel means above the conveyor board for sandwiching a copy sheet therebetween and pulling the sheet into said proper registration in response to driven rotation of the drive wheel means;

carriage means mounted on the machine for reciprocal movement toward and away from the conveyor board and the drive wheel;

spring biased piston means mounted on the carriage means for limited yielding movement relative thereto, the pressure wheel means being rotatably mounted on the piston means for movement with the carriage means toward and away from the drive wheel means and for gripping a copy sheet between the wheel means against the spring bias;

first adjusting means in the form of adjustable abutment means on the carriage means against which the spring biases the piston means, for adjusting the position of the piston means relative to the carriage means and thereby adjusting the dwell time that the wheel means grip the copy sheet; and second adjusting means in the form of a screw member engageable with the spring for adjusting the biasing pressure of the spring.

17. The pull guide mechanism of claim 16 wherein said adjustable abutment means comprise eccentric means rotatably mounted on the carriage means.

18. The pull guide mechanism of claim 17, including third adjusting means in the form of a screw member on the piston means for engaging the eccentric on the carriage means to increase the effective range of the eccentric.

19. The pull guide mechanism of claim 16 wherein said spring comprises a coil spring sandwiched between the piston means and the screw member.

20. A pull guide mechanism for moving a copy sheet over a conveyor board into proper registration in a printing, duplicating or like machine, comprising:

drive wheel means in the conveyor board and pressure wheel means above the conveyor board for sandwiching a copy sheet therebetween and pulling the sheet into said proper registration in response to driven rotation of the drive wheel means;

carriage means mounted on the machine for reciprocal movement toward and away from the conveyor board and the drive wheel;

spring biased piston means mounted on the carriage means for limited yielding movement relative thereto, the pressure wheel means being rotatably mounted on the piston means for movement with the carriage means toward and away from the drive wheel means and for gripping a copy sheet between the wheel means against the spring bias;

first adjusting means for adjusting the position of the piston means relative to the carriage means and thereby adjusting the dwell time that the wheel means grip the copy sheet; and second adjusting means on the piston means operatively associated with the first adjusting means for increasing the effective range of the first adjusting means to set the pull guide mechanism for different weights of copy sheets.

* * * * *